US011255250B1

(12) United States Patent
Chung et al.

(10) Patent No.: US 11,255,250 B1
(45) Date of Patent: Feb. 22, 2022

(54) METHOD FOR PREVENTING ENGINE OVERHEAT BASED ON COOLANT TEMPERATURE AND ENGINE SYSTEM THEREOF

(71) Applicants: HYUNDAI MOTOR COMPANY, Seoul (KR); KIA MOTORS CORPORATION, Seoul (KR)

(72) Inventors: Jae-Sung Chung, Seoul (KR); Seong-Kyu Park, Suwon-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 0 days.

(21) Appl. No.: 17/095,963

(22) Filed: Nov. 12, 2020

(30) Foreign Application Priority Data

Sep. 21, 2020 (KR) ..... 10-2020-0121527

(51) Int. Cl.
*F01P 7/14* (2006.01)
*F01P 7/16* (2006.01)

(52) U.S. Cl.
CPC ..... *F01P 7/167* (2013.01); *F01P 7/164* (2013.01); *F01P 2007/146* (2013.01); *F01P 2025/50* (2013.01); *F01P 2031/20* (2013.01); *F01P 2060/045* (2013.01)

(58) Field of Classification Search
CPC ..... F01P 2007/146; F01P 7/165; F01P 7/14; F01P 2025/50
USPC ..... 123/41.1
See application file for complete search history.

(56) References Cited

U.S. PATENT DOCUMENTS 9,188,051 B1 * 11/2015 Zahdeh ..... F01N 13/1866
2013/0295478 A1 * 11/2013 Han ..... B60L 58/33 429/428
2018/0298806 A1 * 10/2018 Sutherland ..... F01P 3/02
2019/0120178 A1 * 4/2019 Park ..... F01P 7/165

FOREIGN PATENT DOCUMENTS

KR 10-0897125 B1 5/2009

* cited by examiner

*Primary Examiner* — Long T Tran
*Assistant Examiner* — James J Kim
(74) *Attorney, Agent, or Firm* — Lempia Summerfield Katz LLC

(57) ABSTRACT

A method for preventing an engine overheat based on a coolant temperature applied to an engine system 1 is provided, in which a controller 50 checks if a coolant coming from an engine 10 is distributed to any one of a heater core 25B and an ATF warmer 25A as a radiator 23 is switched from a distribution blocking state (i.e., radiator closed) at a diagnosis start to a distribution state (i.e., radiator open) during the diagnosis under the control of an opening degree of an ITM valve 40, diagnoses lack of a coolant amount using factors B determined by an inlet/outlet coolant temperature difference T of the engine 10 through first and second water temperature sensors 30A and 30B as a factor cumulative value A, and then controls the ITM valve 40 to a full open state in a state where a coolant temperature increase is predicted.

20 Claims, 5 Drawing Sheets

METHOD FOR PREVENTING ENGINE OVERHEAT BASED ON COOLANT TEMPERATURE AND ENGINE SYSTEM THEREOF

CROSS-REFERENCE TO RELATED APPLICATION

This application claims priority to and the benefit of Korean Patent Application No. 10-2020-0121527, filed on Sep. 21, 2020, the entire contents of which are incorporated herein by reference.

FIELD

Exemplary forms of the present disclosure relate to the coolant temperature control, and particularly, to an engine system which performs an engine overheat prevention control to protect mechanical devices associated with an engine.

BACKGROUND

The statements in this section merely provide background information related to the present disclosure and may not constitute prior art.

In general, in case of using an internal combustion engine (hereinafter, engine) as a power source of a vehicle, engine coolant (hereinafter, coolant) is one of the important means for engine cooling.

Accordingly, an engine has no choice but to be sensitive to the lack of the coolant, which makes it difficult to operate a mechanical device using an engine torque due to the damage caused by the engine overheat.

Because of this, an engine system performs continuous monitoring with respect to a coolant amount and a coolant temperature to maintain a normal operation of the engine.

As an example, the engine system performs sensor type coolant monitoring through application of a flow sensor and a temperature sensor to an engine cooling system. In this case, the flow sensor is applied to the monitoring of the amount of coolant that circulates in the engine cooling system, and the temperature sensor is applied to the monitoring of the temperature of the coolant that circulates in the engine cooling system using the coolant temperature sensor.

Accordingly, the sensor type coolant monitoring is performed so that the shortage or lack of the coolant amount is prevented from occurring through the coolant amount monitoring of the flow sensor and the coolant overheat (or engine overheat) is displayed and warned in a cluster of a driver's seat with respect to the coolant temperature that is equal to or higher than a specific value by monitoring the coolant temperature that is equal to or lower than a reference value, the coolant temperature that is equal to or higher than the reference value, and the sensor value variation for a specific time through the coolant temperature sensor.

Through this, the engine system can be safely operated without any danger of engine overheat and damage.

However, we have discovered that the above-described sensor type coolant monitoring has the following limitations.

As an example, the flow sensor is unable to be applied to most vehicles due to cost problems.

Further, although the coolant temperature sensor checks the detection of the coolant temperature that is equal to or higher than the specific temperature value against the reference value as overheat information on the coolant (or engine), the overheat information indicates a dangerous situation in which the engine operation should immediately be stopped, and this may cause an abrupt situation change to stop a vehicle movement for repairing the cooling system of the engine system or a work being performed by a mechanical device using an engine torque without any preparation.

SUMMARY

The present disclosure provides a method for preventing an engine overheat based on a coolant temperature and an engine system thereof, which can overcome the limitations of coolant overheat information being grasped to be equal to or higher than a specific temperature against a reference temperature by preemptively predicting a coolant temperature increase through diagnosis of lack of a coolant amount based on a coolant temperature, and can prevent an abrupt situation change from occurring by enabling the minimum vehicle movement while protecting an engine and associated mechanical devices by proceeding with the coolant overheat as late as possible with a fail-safe control using an opening degree of an integrated thermal management (ITM), the engine, and a cooling fan especially in the coolant temperature increase prediction state.

Other objects and advantages of the present disclosure can be understood by the following description, and become apparent with reference to the forms of the present disclosure. Also, it is obvious to those skilled in the art to which the present disclosure pertains that the objects and advantages of the present disclosure can be realized by the exemplary forms of the present disclosure.

In one form of the present disclosure, a method for preventing an engine overheat based on a coolant temperature includes: checking, by a controller, a specific state of an integrated thermal management (ITM) state for distributing a coolant of an ITM valve; checking an inlet/outlet coolant temperature difference between an inlet coolant temperature detected by a first coolant temperature sensor at an inlet of an engine and an outlet coolant temperature detected by a second coolant temperature sensor at an outlet of the engine, and checking a lack of a coolant amount by a factor in accordance with a region of the inlet/outlet coolant temperature difference; and delaying an increase of the coolant temperature by cooling the coolant while distributing the coolant under the control of an opening degree of the ITM valve.

In one form, in the ITM state, any one of ITM state 3, ITM state 4, and ITM state 5, in which the coolant is distributed to a heat exchanger composed of any one of a heater core and an ATF warmer as a distribution state of the coolant for a radiator is changed under the control of the opening degree of the ITM valve, is applied as the specific state.

In another form, in the ITM state 3, the radiator is controlled to be closed with respect to the distribution of the coolant, whereas the ATF warmer is controlled to be open together with a partial opening of the heater core.

As other form, in the ITM state 4, the radiator is controlled to be partially open with respect to the distribution of the coolant, whereas the ATF warmer is controlled to be open together with a partial opening of the heater core.

As an exemplary form, in the ITM state 5, the radiator is controlled to be open with respect to the distribution of the coolant, whereas the ATF warmer is controlled to be open together with a partial opening of the heater core.

As one form, the ITM state includes ITM state 1 and ITM state 2, and in the ITM state 1, the radiator and the ATF warmer are controlled to be closed with respect to the distribution of the coolant, whereas the heater core is controlled to be open, and in the ITM state 2, the radiator and the heater core are controlled to be closed with respect to the distribution of the coolant, whereas the ATF warmer is controlled to be partially open.

In one form, the control of the coolant flow diagnosis is performed by checking the inlet/outlet coolant temperature difference by the inlet coolant temperature and the outlet coolant temperature, determining factors by temperature difference ranges by checking the region of the inlet/outlet coolant temperature difference, calculating a factor cumulative value by determining the factors by the temperature difference ranges as many as the number of times of repeated checking of the inlet/outlet coolant temperature difference, and checking the lack of the coolant amount by the factor cumulative value.

In some forms, the inlet/outlet coolant temperature difference is calculated as a temperature difference value obtained by subtracting the inlet coolant temperature from the outlet coolant temperature, and the factors by the temperature difference ranges are applied as different factor granted values in accordance with a size of the temperature difference value.

In some forms, the temperature difference value is divided in the unit of 10° C., and the factor granted value is set to −1, 0, 1, 2, and 3 with respect to the temperature difference values of 0° C., 10° C., 20° C., 30° C., and 40° C., respectively.

In some forms, the lack of the coolant amount is checked at the factor cumulative value that is larger than a factor threshold value.

In some forms, the engine protection control is performed by switching the ITM valve to a full open state so that the coolant is distributed to a heat exchanger composed of any one of a heater core and an ATF warmer as the coolant is distributed to a radiator, and operating a mechanical device associated with the engine to cool the coolant.

As one form, the mechanical device is any one of a fuel injection device controlling a fuel injection in a limp home control mode of the engine and a cooling fan blowing and sending an outdoor air to the radiator.

As another form, a warning light is turned on in a cluster of a driver's seat during an opening degree control of the ITM valve or an operation control of the mechanical device.

As one form, the controller resets and initializes the factor or stores the factor in a memory when an operation of the engine is stopped.

In accordance with another form of the present disclosure, an engine system includes: a first coolant temperature sensor detecting a coolant inlet temperature at an inlet of an engine; a second coolant temperature sensor detecting a coolant outlet temperature at an outlet of the engine; an integrated thermal management (ITM) valve distributing a coolant to a heat exchanger associated with a radiator; a controller checking that the coolant is distributed to the heat exchanger together with the radiator being switched from a closed state at a start of diagnosis to an open state during the diagnosis under the control of an opening degree of the ITM valve, calculating factors by temperature difference ranges as a factor cumulative value by an inlet/outlet coolant temperature difference calculated as a difference between the inlet coolant temperature and the outlet coolant temperature, and controlling the ITM valve to a full open state in case that a lack of a coolant amount is diagnosed; and an emergency control system being operated under the control of the controller and delaying an increase of the coolant temperature.

As one form, the heat exchanger includes a heater core raising an outdoor temperature through a heat exchange with the coolant and an ATF warmer performing heat exchange between an auto transmission fluid and the coolant.

As another form, the controller is provided with an emergency map, and in the emergency map, the inlet/outlet coolant temperature difference is divided in the unit of 10° C. to calculate factors by temperature difference ranges, and the factors by the temperature difference ranges are applied as different factor granted values in accordance with the temperature differences. The factor granted values are calculated as a factor cumulative value, and the diagnosis of the lack of the coolant amount is checked in case that the factor cumulative value is larger than a factor threshold value.

In one form, the emergency control system includes a fuel injection device converting a fuel injection into a condition of a limp home control mode, a cooling fan blowing an outdoor air to the radiator, and a warning light being turned on in a cluster of a driver's seat.

The method for preventing the engine overheat based on the coolant temperature applied to the engine system according to the present disclosure implements the following works and effects.

First, it is possible to grasp whether the coolant flow rate is abnormal even without using the flow sensor by diagnosing the lack of the coolant flow rate that increases the coolant temperature with the temperature value of the coolant temperature sensor. Second, the driver can pre-check the coolant overheat through the pre-prediction that is not the post check by the overheat information equal to or higher than the specific temperature against the reference temperature. Third, the engine driving is maintained by the fail-safe control that proceeds with the coolant overheat as late as possible during the prediction of the coolant overheat to enable the minimum vehicle movement. Fourth, it is possible to prevent the engine burst and to check and repair the cooling system in the situation in which the engine overheat is expected due to the lack of the coolant by applying the fail-safe control to the ITM valve, the engine, and the cooling fan to enable the engine output limitation and quick coolant temperature decrease. Fifth, the ITM valve opens all the flow paths of the coolant to maximally operate the cooling fan, and thus the cooling efficiency of the coolant can be maximized. Sixth, it is possible to protect the engine and the associated mechanical devices and to prevent the system damage by guiding the driver, who pre-checks the situation of the coolant leakage/lack through the display of the cluster of the driver's seat, to check/repair the cooling system before the driver meets the dangerous situation.

It is to be understood that both the foregoing general description and the following detailed description of the present disclosure are exemplary and explanatory and are intended to provide further explanation of the disclosure as claimed.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1A:
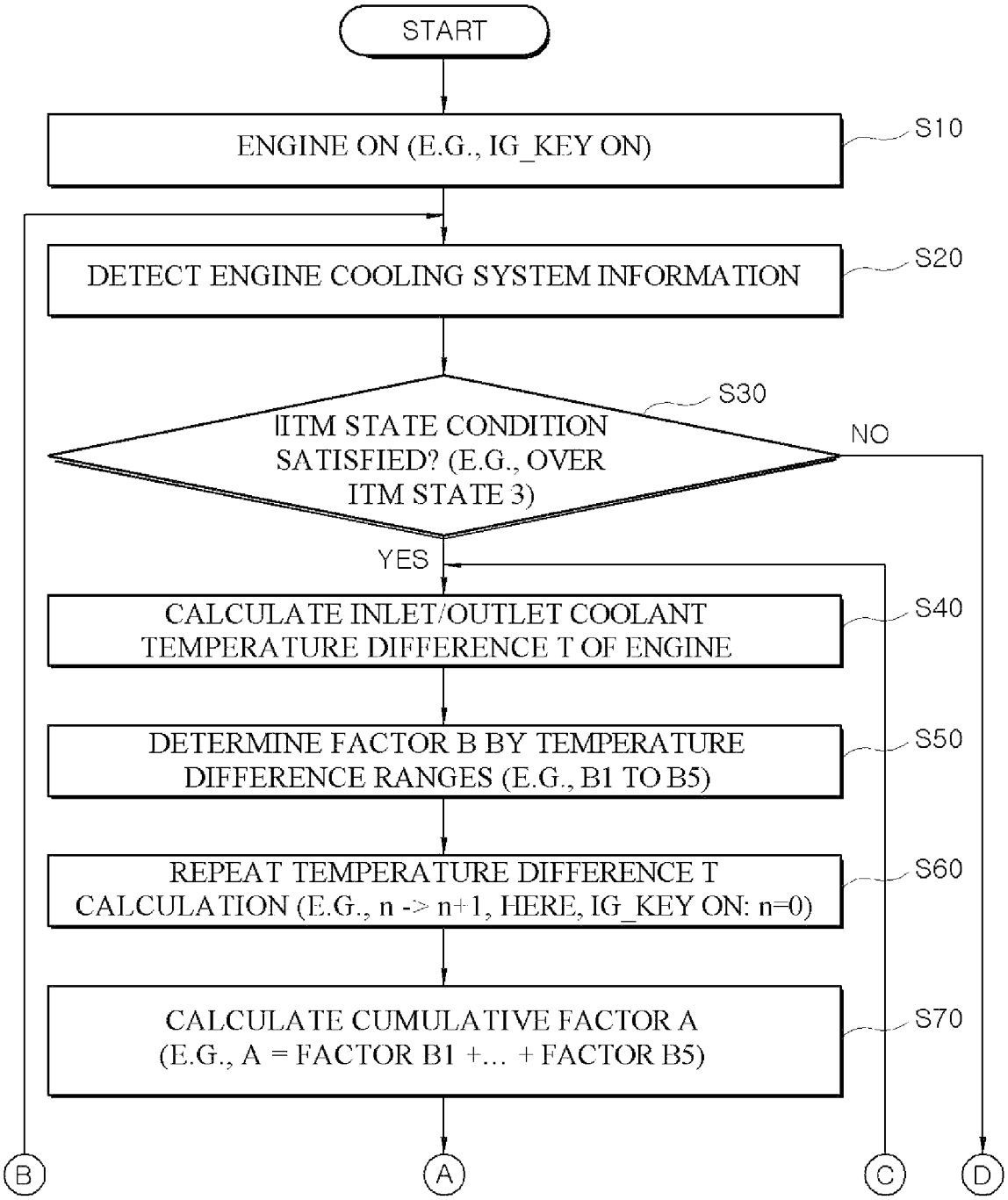
FIGS. 1A and 1B are flowcharts illustrating a method for preventing an engine overheat based on a coolant temperature in one form of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Hereinafter, exemplary forms of the present disclosure will be described in detail with reference to the accompanying drawings. Such forms are exemplary and those of ordinary skill in the art to which the present disclosure pertains will be able to implement the forms in various different forms. Accordingly, the present disclosure is not limited to the forms as described herein.

Figure 1B:
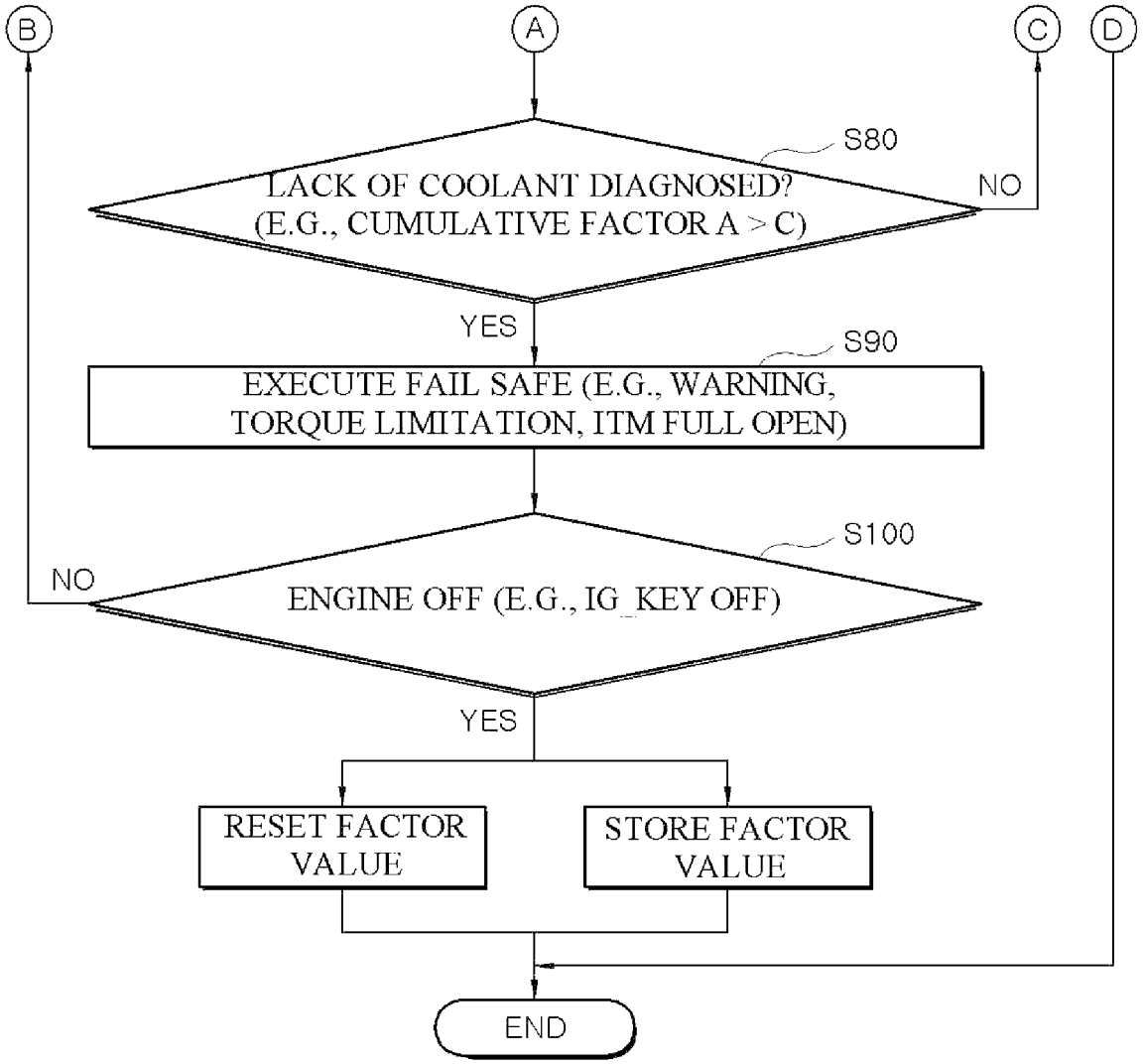

Referring to FIGS. 1A and 1B, a method for preventing an engine overheat based on a coolant temperature is performed through a valve check control (S10 to S30), a coolant flow diagnosis control (S40 to S80), an engine protection control (S90), and a diagnosis initialization control (S100 to S300).

In particular, the coolant flow diagnosis control (S40 to S80) repeats calculation of an inlet/outlet coolant temperature difference T with respect to a coolant inlet and a coolant outlet of an engine, obtains a cumulative factor A therefrom, and then diagnoses lack of the coolant through checking of the cumulative factor A. Accordingly, the a coolant amount of the engine is diagnosed only by a coolant temperature sensor without using a separate flow sensor.

Further, the engine protection control (S90) controls an opening degree of an ITM valve that is an integrated flow control valve to a full open state under a driver warning with respect to the lack (or shortage) of the coolant amount checked by the coolant temperature sensor to inhibit or prevent an additional increase of the coolant, and executes a fail-safe control for an engine torque limitation and the maximum cooling fan operation to preemptively prevent the coolant overheat and the engine overheat.

According to one form of the method for preventing the engine overheat based on the coolant temperature, an engine system, to which a flow sensor is not applied, can implement a feature that can pre-recognize an overheat situation due to the lack of the coolant amount only by the coolant temperature sensor, and can secure a necessary vehicle movement distance to visit a repair shop in a coolant lack or shortage situation through maximization of a cooling efficiency of a cooling system while protecting the engine from being damaged.

Figure 2:
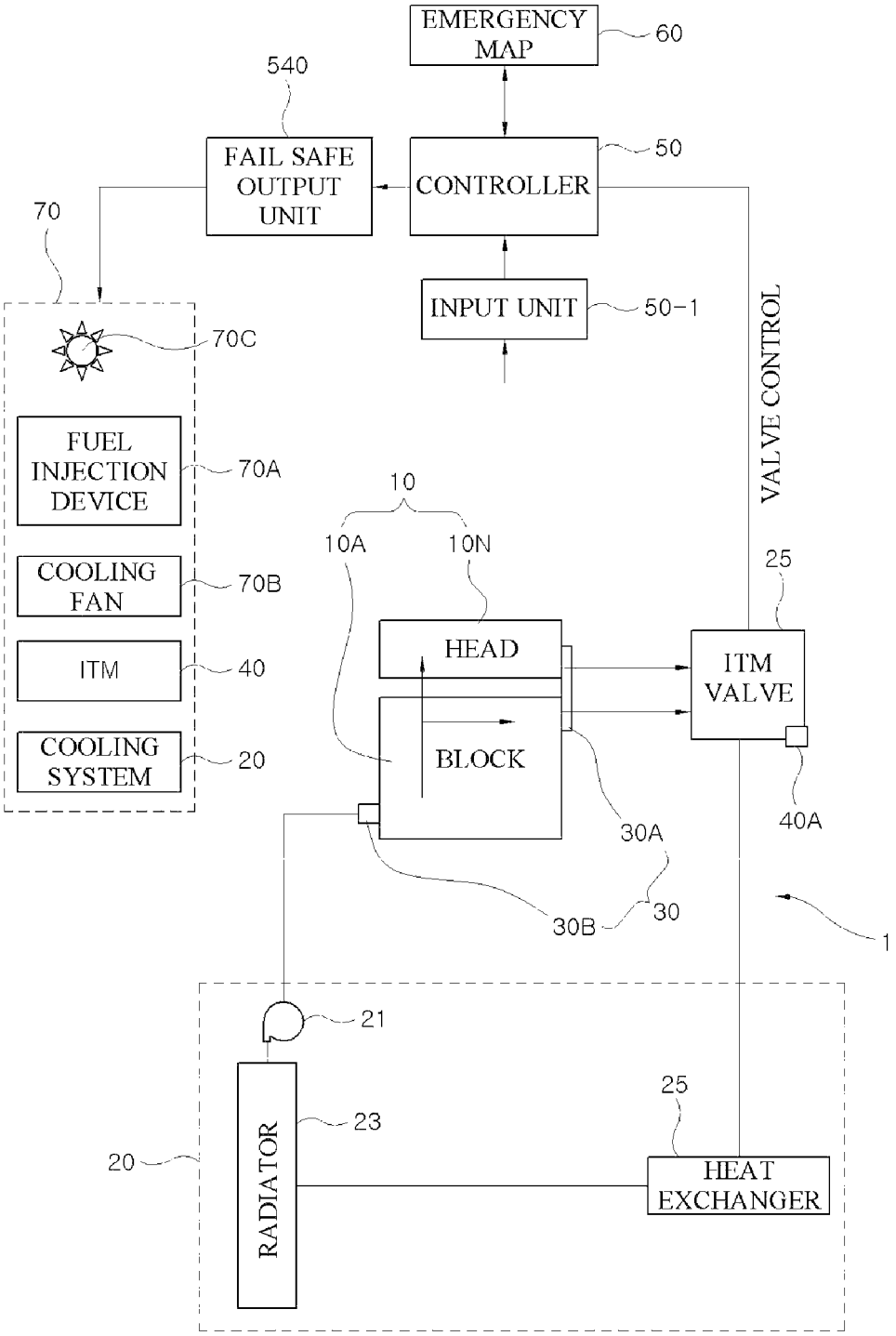
FIG. 2 is a diagram of an example of an engine system which performs an engine overheat prevention control in one form of the present disclosure.

Referring to FIG. 2, an engine system 1 includes an engine 10, a cooling system 20, a water temperature sensor 30, an integrated thermal management (ITM) valve 40, a controller 50, and an emergency control system 70.

As an example, the engine 10 is an internal combustion engine including a cylinder block 10A having a combustion chamber in which a piston associated with a crank shaft reciprocates and a cylinder head 10B having a valve device associated with a cam shaft, and although not illustrated, the internal combustion engine includes all generally required components of the internal combustion engine.

In particular, the cylinder block 10A is a coolant block outlet that discharges the coolant to the ITM valve 40, and the cylinder head 10B is a coolant head outlet that discharges the coolant to the ITM valve 40.

As an example, the cooling system 20 includes a water pump 21, a radiator 23, and a heat exchanger 25. The water pump 21 forms a coolant circulation for the engine 10 and the cooling system 20, and may be a mechanic water pump connected to the crank shaft by a belt or a chain, or an electronic water pump being driven under the control of the controller 50. The radiator 23 cools the coolant, and heightens the cooling efficiency through air being blown from a cooling fan 70B.

In particular, the heat exchanger 25 is composed of an auto transmission fluid (ATF) warmer 25A raising the temperature through heat exchange between an auto transmission fluid and the coolant, and a heater core 25B raising an outdoor temperature through heat exchange with an engine coolant. However, the heat exchanger 25 may further include an exhaust gas recirculation (EGR) cooler lowering a temperature of an EGR gas being sent to the engine among exhaust gases through heat exchange with the engine coolant, and an oil warmer raising the temperature of an engine oil through heat exchange with the coolant.

As an example, the water temperature sensor 30 detects the temperature of the coolant coming in and out of the engine 10 and provides the detected temperature to the controller 50. For this, the water temperature sensor 30 is composed of a first water temperature sensor 30A detecting the temperature of an inlet side of the cylinder block 10A and a second water temperature sensor 30B detecting the temperature of outlet sides of the cylinder block 10A and the cylinder head 10B.

As an example, the ITM valve 40 receives an inflow of the coolant coming out of the outlets of the cylinder block 10A and the cylinder head 10B, and forms distribution of the coolant with respect to the radiator 23 and the heat exchanger 25 of the cooling system 20 through the valve opening degree control of the controller 50. For this, the ITM valve 40 is provided with a valve location sensor 40A, and transmits, to the controller 50, the location of the valve opening degree detected by the valve location sensor 40A.

Figure 3:
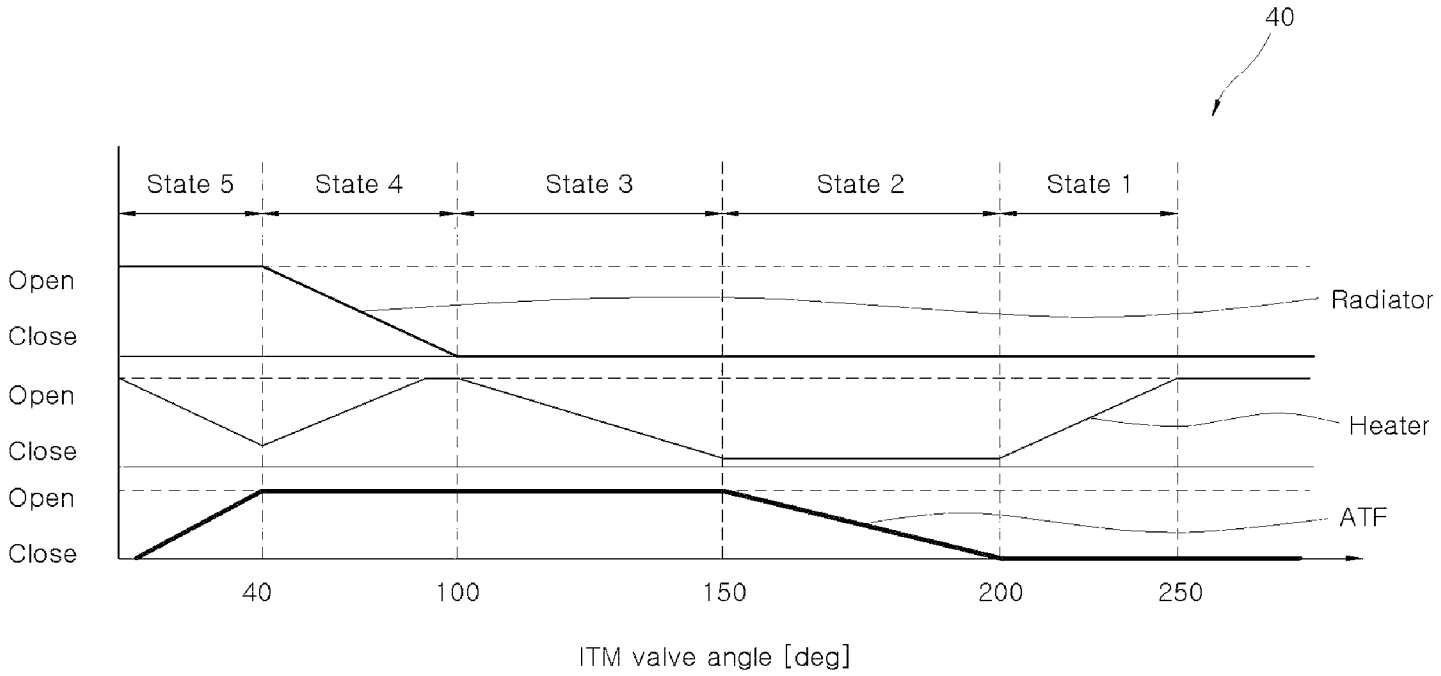
FIG. 3 is a diagram of an example of a valve state of an ITM valve applied to a cooling system of an engine system according to one form of the present disclosure.

In particular, as the valve opening degree control of the controller 50, the ITM valve 40 implements state 1 to state 5 as a coolant control mode (refer to FIG. 3).

As an example, for the coolant control mode of the cooling system 20, the controller 50 is provided with a memory for storing a logic or a program for a valve opening degree matching and valve check control (S10 to S30) of the ITM valve 40, a coolant flow diagnosis control (S40 to S80), an engine protection control (S90), and a diagnosis initialization control (S100 to S300), outputs a valve control signal for the ITM 1 with a pulse width modulation (PWM) duty, and operates as a central processing unit that implements logic processing of a program or an algorithm.

For this, the controller 50 outputs a control signal for the ITM valve 40, and is associated with an input unit 50-1, a fail-safe output unit 50-2, and an emergency map 60. The input unit 50-1 has a basic function of detecting information on the engine 10 and the cooling system 20, and detects the coolant temperature and the valve opening degree. The fail-safe output unit 50-2 transmits the control signal to the emergency control system 70. The emergency map 60 matches cumulative factors A for an inlet/outlet coolant temperature difference T.

Hereinafter, the controller 50, the input unit 50-1, the fail-safe output unit 50-2, and the emergency map 60 will be described in detail through FIG. 4.

As an example, the emergency control system 70 includes the ITM valve 40 and components of the cooling system 20 together with a fuel injection device 70A, a cooling fan 70B, and a warning light 70C. The fuel injection device 70A is provided in the cylinder head 10B of the engine 10, and reduces an engine torque by reducing a fuel injection amount through a limp home mode control of the controller 50. The cooling fan 70B is driven under the control of the controller 50, and blows an outdoor air to the radiator 23. The warning light 70C is provided in a cluster of a driver's seat, and is turned on or is displayed to notify of the lack or shortage of the coolant under the control of the controller 50.

Hereinafter, the method for preventing the engine overheat based on the coolant temperature of FIGS. 1A and 1B will be described in detail through FIGS. 2 to 4. In this case, a control subject is the controller 50, and a control target is one or more of the ITM valve 40, the water pump 21, the radiator 23, the heat exchanger 25, the fuel injection device 70A, the cooling fan 70B, and the warning light 70C.

First, the controller 50 enters the valve check control (S10 to S30), and performs detection of engine cooling system information of S20 during an engine ON of S10 and checking whether the ITM state condition of S30 is satisfied. In this case, the engine ON (S10) is a start operation of the engine 10 by an IG-key ON, and in the same manner as a normal procedure, it is recognized by an engine electronic control unit (ECU) (not illustrated) and is transmitted to the controller 50.

Referring to FIG. 2, the controller 50 checks an engine revolution per minute of the engine 10 detected by an engine sensor (not illustrated) that is detection information of the associated input unit 50-1, a coolant temperature of the cooling system 20 detected by the first and second water temperature sensors 30A and 30B, and a valve opening degree location of the ITM valve 40 detected by the valve location sensor 40A, and through this, the controller 50 performs the engine cooling system information detection (S20).

Further, the controller 50 performs checking of the ITM state condition satisfaction (S30) as the current ITM state at the valve opening degree location of the ITM valve 40 among the engine cooling system information. As an example, the checking of the ITM state condition satisfaction (S30) is performed by applying a case that the ITM valve 40 is equal to or higher than ITM state 3.

Referring to FIG. 3, the ITM state diagram of the ITM valve 40 indicates the flow rate of the coolant being distributed to the radiator 23, the ATF warmer 25A, and the heater core 25B, respectively, at an angle of the valve opening degree (e.g., 0 to 250°) for the valve open and closed.

As an example, in the ITM state 1, the coolant is not distributed to the radiator 23 and the ATF warmer 25A, whereas the coolant is distributed to the heater core 25B. This means that the opening degree control of the ITM valve 40 is performed so that the radiator 23 and the ATF warmer 25A are closed, whereas the heater core 25B is open with respect to the distribution of the coolant.

In the ITM state 2, the coolant is not distributed to the radiator 23 and the heater core 25B, whereas the distribution of the coolant to the ATF warmer 25A is reduced. This means that the opening degree control of the ITM valve 40 is performed so that the radiator 23 and the heater core 25B are closed, whereas the ATF warmer 25A is partially open with respect to the distribution of the coolant.

In the ITM state 3, the coolant is not distributed to the radiator 23, whereas the distribution of the coolant to the heater core 25B is reduced and the distribution of the coolant to the ATF warmer 25A is maintained. This means that the opening degree control of the ITM valve 40 is performed so that the radiator 23 is closed, whereas the heater core 25B is partially open and the ATF warmer 25A is open with respect to the distribution of the coolant.

In the ITM state 4, the distribution of the coolant to the radiator 23 is reduced, whereas the distribution of the coolant to the heater core 25B is increased and the distribution of the coolant to the ATF warmer 25A is maintained. This means that the opening degree control of the ITM valve 40 is performed so that the radiator 23 is partially open, whereas the heater core 25B is partially open and the ATF warmer 25A is open with respect to the distribution of the coolant.

In the ITM state 5, the distribution of the coolant to the radiator 23 is maintained, whereas the distribution of the coolant to the heater core 25B is reduced and the distribution of the coolant to the ATF warmer 25A is increased. This means that the opening degree control of the ITM valve 40 is performed so that the radiator 23 is open, whereas the heater core 25B is partially open and the ATF warmer 25A is open with respect to the distribution of the coolant.

Accordingly, the checking of the ITM state condition satisfaction (S30) may cause a danger due to the coolant overheat or engine overheat in case of the lack of the coolant in a state where the ITM valve 40 is equal to or higher than ITM state 3.

Through this, the controller 50 enters the coolant flow diagnosis control (S40 to S80) in case that the current coolant control mode corresponds to any one of ITM state 3, ITM state 4, and ITM state 5 through the checking of the ITM state condition satisfaction (S30).

Then, the controller 50 enters the coolant flow diagnosis control (S40 to S80), and performs inlet/outlet coolant temperature calculation of the engine (S40), factor determination by temperature difference ranges (S50), temperature difference calculation repetition (S60), cumulative factor calculation (S70), and diagnosis of the lack of the coolant (S80).

Figure 4:
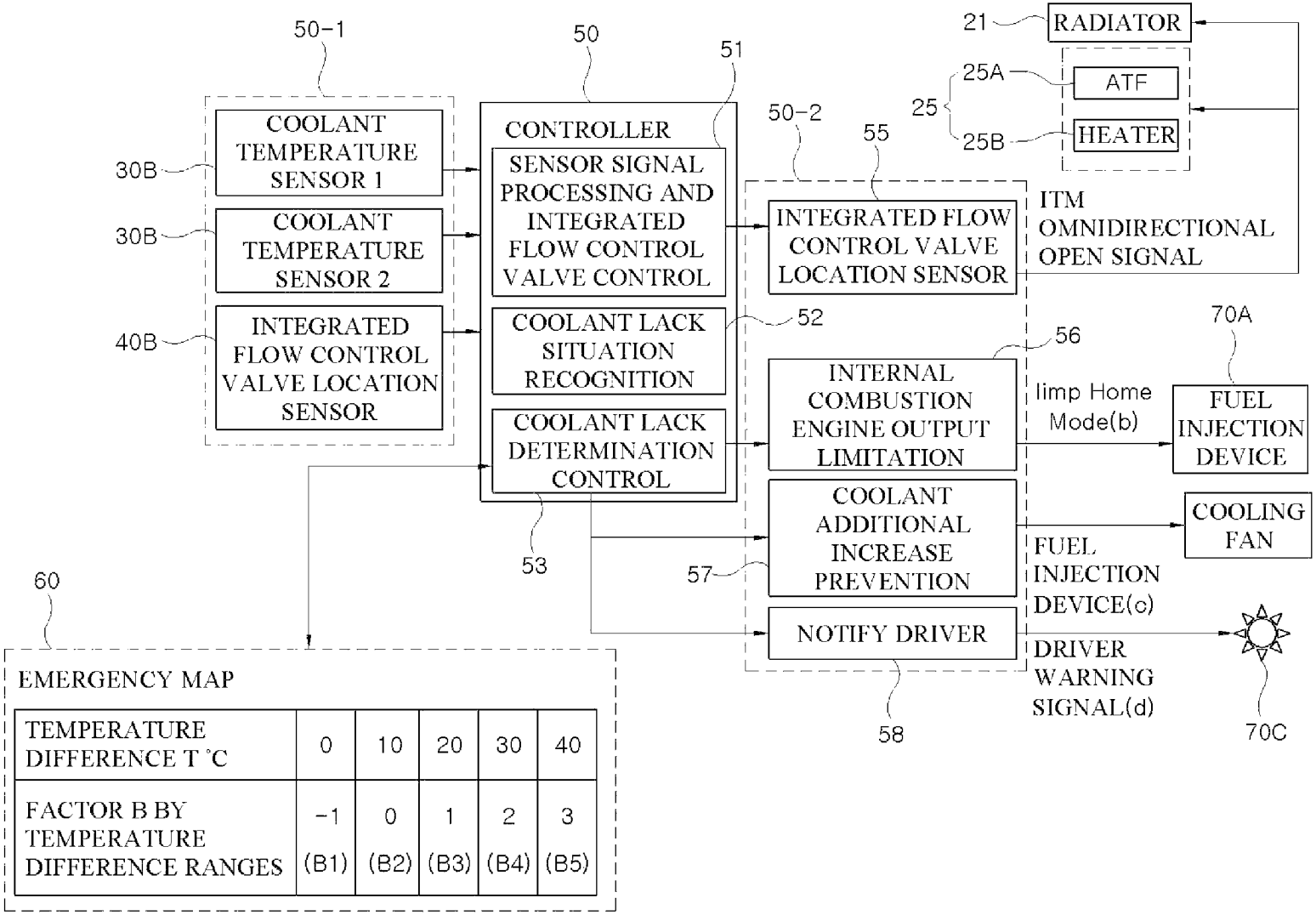
FIG. 4 is a diagram of an operation state of an engine system according to one form of the present disclosure to cope with lack of a coolant.

Referring to FIG. 4, the controller 50 checks, through a data processor 51 constituting the controller 50, the inlet coolant temperature coming into the cylinder block 10A of the engine 10 detected by the first and second water temperature sensors 30A and 30B and the outlet coolant temperature coming out of the cylinder block 10A and the cylinder head 10B of the engine 10 among the detected information of the associated input unit 50-1. Then, the controller 50 performs the inlet/outlet coolant temperature difference calculation (S40) through the logic processor 52 using the following inlet/outlet coolant temperature difference calculation formula.

Inlet/outlet coolant temperature difference calculation formula: $T=T_{outlet}-T_{inlet}$ Herein "T" denotes an inlet/outlet coolant temperature difference, "$T_{inlet}$" denotes a temperature detected by the first water temperature sensor 30A as an engine inlet temperature of the engine 10, "$T_{outlet}$" denotes an engine outlet temperature of the engine 10 detected by the second water temperature sensor 30B, and "−" is a sign that indicates subtraction of two values.

Then, the controller 50 uses the resultant value of the inlet/outlet coolant temperature difference T through a determination processor 53, and performs factor determination (S50) by temperature difference ranges using the following factor granted formula.

Factor granted formula: $t=T\rightarrow B$

Here, "t" denotes a mapping temperature difference of the emergency map 60, "=" is a sign indicating that two values are equal to each other, "B" denotes a factor by temperature difference ranges, and "4" indicates that t=T is granted to B on a condition of "t=T".

In particular, the mapping temperature difference t divides the temperature region in the unit of about 10° C., and this is caused by setting a case that the inlet/outlet coolant temperature difference T is equal to or lower than about 12° C. as a normal coolant flow rate.

Accordingly, the mapping temperature difference t of the emergency map 60 is divided into 0° C., 10° C., 20° C., 30° C., and 40° C., and grants the factors B by temperature difference ranges of B1, B2, B3, B4, and B5 with respect to the divided temperatures.

That is, 0° C. is matched to B1, and the factor granted value is set to −1. 10° C. is matched to B2, and the factor granted value is set to 0. 20° C. is matched to B3, and the factor granted value is set to 1. 30° C. is matched to B4, and the factor granted value is set to 2. 40° C. is matched to B5, and the factor granted value is set to 3. However, the mapping temperature difference t, the factor B by temperature difference ranges, and the factor granted value may be set to be narrower or wider than those as described above.

As a result, the controller 50 performs the factor determination (S50) by temperature difference ranges through the determination processor 53.

As an example, if the result of "$T=T_{outlet}-T_{inlet}$" is 0° C.(T), the controller 50 sets the factor B by temperature difference ranges to "−1(B1)" in consideration of the factor granted value of B1. In contrast, if the result of "$T=T_{outlet}-T_{inlet}$" is 40° C.(T), the controller 50 sets the factor B by temperature difference ranges to "3(B5)" in consideration of the factor granted value of B5, resulting in that the controller 50 successively increases the figure by 1 with respect to 10° C.(T).

In this case, the controller 50 sets the first number of times of temperature difference calculation with respect to any one factor granted value of the factors B by temperature difference ranges of B1 to B5 obtained at the inlet/outlet coolant temperature difference calculation operation of S40 and the factor determination operation by temperature difference ranges of S50 to n=0. In particular, the controller 50 prevents unnecessary count accumulation by setting the number to n=0 at an initial start in accordance with the engine ON checking of S10.

Then, the controller 50 performs temperature difference calculation repetition (S60), and the temperature difference calculation repetition (S60) is a process of checking the factor granted value classified into 5 kinds of B1 to B5.

Accordingly, the temperature difference calculation repetition (S60) may be repeated 5 times in case that B5 is checked among B1 to B5 in the diagnosis process. However, since B5 that is the mapping temperature difference t of 40° C. is a relatively large temperature difference value, B5 may not occur in the actual diagnosis process, and thus S60 may not be repeated up to 5 times. This may be equally applied even with respect to B4 that is the mapping temperature difference t of 30° C.

Thereafter, the controller 50 determines the coolant lack diagnosis (S80) after performing the cumulative factor calculation (S70), and for this, the controller 50 applies the following factor cumulative value checking formula and coolant amount diagnosis formula.

Factor cumulative value checking formula: $A=B1+, \ldots, +B5$, or $A=B1+, \ldots, +B4$, or $A=B1+, \ldots, +B3$ Coolant amount diagnosis formula: $A>C?$ Here, "A" denotes a factor cumulative value, and "B1, B2, B3, B4, B5" denote factor granted values. "C" denotes a factor threshold value of the lack of the coolant amount, and in consideration of the coolant temperature difference T of about 12° C., "C" is set to "1" to match 20° C. of the mapping temperature difference t, or is set to "2" to match 30° C. "+" is a summation sign of two values, and ">" is an inequality sign indicating a size relationship between two values.

As a result, the controller 50 performs the temperature difference calculation repetition (S60) 5 times of "A=B1+, . . . , B5", or 4 times of "A=B1+, . . . , B4", or 3 times of "A=B1+, . . . , +B3", and then if the factor cumulative value A is equal to or larger than the factor threshold value C of "1" or "2" in case of "A>C" from the result, the controller 50 recognizes the coolant lack situation, and switches to the engine protection control of S90.

Continuously, the controller 50 preemptively prevents the coolant overheat and the engine overheat in the coolant lack situation by executing the engine protection control (S90) through the fail-safe control.

Referring to FIG. 4, the controller 50 executes the fail-safe control by directly controlling one or more of the radiator 23, the ATF warmer 25A, the heater core 25B, the fuel injection device 70A, the cooling fan 70B, and the warning light 70C in association with the fail-safe output unit 50-2.

As an example, the controller 50 operates the valve output port 55 of the fail-safe output unit 50-2 through the data processor 51.

That is, the controller 50 sends an ITM omnidirectional open signal a of the data processor 51 to the valve output port 55, and outputs the ITM valve location control to the ITM valve 40. Then, the ITM valve 40 is switched to a full open state, and is opened in all directions in which the ITM valve 40 is connected to the radiator 23, the ATF warmer 25A, and the heater core 25B to make the coolant coming out of the engine 10 be distributed to the radiator 23, the ATF warmer 25A, and the heater core 25B.

Through this, in the cooling system 20, all devices using the coolant perform heat exchange with the high-temperature coolant to greatly contribute to the lowering of the coolant temperature.

At the same time, the controller 50 operates an engine output port 56, a fan output port 57, and a warning output port 58 of the fail-safe output unit 50-2 through the determination processor 53.

That is, the controller 50 sends a limp home mode b of the determination processor 53 to the engine output port 56 to reduce a fuel injection amount of the fuel injection device 70A, and makes other associated devices enter the limp home mode to reduce an engine torque of the engine 10, so that the controller 50 greatly contributes to the suppression of the coolant temperature increase.

Further, the controller 50 sends a fan driving signal c of the determination processor 53 to the engine output port 56 to make the cooling fan 70B maximally operate, and thus the controller 50 greatly contributes to the suppression of the coolant temperature increase.

In addition, the controller 50 sends a driver warning signal d of the determination processor 53 to the warning output port 58 to make the warning light 70C in the cluster of the driver's seat notify of the lack or shortage of the coolant, and thus the controller 50 guides the driver to perform repair/check against a danger of damage of the engine 10 and mechanical devices mounted thereon due to the coolant overheat caused by the lack of the coolant flow rate.

The controller enters the diagnosis initialization control (S100 to S300), and performs factor value reset of S200 or factor value storage of S300 during the engine OFF of S100.

As an example, the engine OFF (S100) is recognized by the controller 50 through reception of IG_key OFF checking information by an engine ECU.

As an example, the factor value reset (S200) deletes the result of the cumulative factor calculation of S70 from the memory of the controller 50 to prevent unnecessary data from occupying a memory space. In contrast, the factor value storage (S300) stores the result of the cumulative factor calculation of S70 in the memory of the controller 50 to use the result of the cumulative factor calculation as OBD information during a later maintenance of the engine 10.

As described above, according to the method for preventing the engine overheat based on the coolant temperature applied to the engine system 1 according to the present form, the controller 50 checks if the coolant coming from the engine 10 is distributed to any one of the heater core 25B and the ATF warmer 25A as the radiator 23 is switched from the distribution blocking state (i.e., radiator closed) of the radiator 23 at the diagnosis start to the distribution state (i.e., radiator open) of the radiator 23 during the diagnosis under the control of the opening degree of the ITM valve 40, diagnoses the lack of the coolant amount using the factors B determined by the inlet/outlet coolant temperature difference T of the engine 10 through the first and second water temperature sensors 30A and 30B as the factor cumulative value A, and then controls the ITM valve 40 to the full open state in a state where the coolant temperature increase is predicted through the driver warning of the warning light 70C, so that the coolant overheat and the abrupt situation change are prevented from occurring through enabling of the minimum vehicle movement with the fuel injection control of the fuel injection device 70A in accordance with the limp home control mode and the cooling efficiency increase of the radiator 23 of the cooling fan 70B.

While the present disclosure has been described with respect to the specific forms, it will be apparent to those skilled in the art that various changes and modifications may be made without departing from the spirit and scope of the present disclosure.

What is claimed is:

1. A method for preventing an engine overheat based on a coolant temperature, the method comprising:

checking, by a controller, a specific state of an integrated thermal management (ITM) state for distributing a coolant of an ITM valve;

checking an inlet/outlet coolant temperature difference between an inlet coolant temperature detected by a first coolant temperature sensor at an inlet of an engine and an outlet coolant temperature detected by a second coolant temperature sensor at an outlet of the engine, and checking a lack of a coolant amount by a factor based on a region of the inlet/outlet coolant temperature difference; and delaying an increase of the coolant temperature by cooling the coolant while distributing the coolant under a control of an opening degree of the ITM valve.

2. The method according to claim 1, wherein in the ITM state, any one of an ITM state 3, an ITM state 4, and an ITM state 5, in which the coolant is distributed to a heat exchanger as a distribution state of the coolant for a radiator is changed under the control of the opening degree of the ITM valve, is applied as the specific state, and wherein the heat exchanger includes at least one of a heater core or an ATF warmer.

3. The method according to claim 2, wherein in the ITM state 3, the radiator is controlled to be closed with respect to the distribution of the coolant, whereas the ATF warmer is controlled to be open together with a partial opening of the heater core.

4. The method according to claim 2, wherein in the ITM state 4, the radiator is controlled to be partially open with respect to the distribution of the coolant, whereas the ATF warmer is controlled to be open together with a partial opening of the heater core.

5. The method according to claim 2, wherein in the ITM state 5, the radiator is controlled to be open with respect to the distribution of the coolant, whereas the ATF warmer is controlled to be open together with a partial opening of the heater core.

6. The method according to claim 2, wherein the ITM state comprises an ITM state 1 and an ITM state 2, and in the ITM state 1, the radiator and the ATF warmer are controlled to be closed with respect to the distribution of the coolant, whereas the heater core is controlled to be open, and in the ITM state 2, the radiator and the heater core are controlled to be closed with respect to the distribution of the coolant, whereas the ATF warmer is controlled to be partially open.

7. The method according to claim 1, wherein a control of a coolant flow diagnosis is performed by:

checking the inlet/outlet coolant temperature difference by the inlet coolant temperature and the outlet coolant temperature;

determining factors by temperature difference ranges by checking the region of the inlet/outlet coolant temperature difference;

calculating a factor cumulative value by determining the factors by the temperature difference ranges as many as a number of times of repeated checking of the inlet/outlet coolant temperature difference; and checking the lack of the coolant amount by the factor cumulative value.

8. The method according to claim 7, wherein the inlet/outlet coolant temperature difference is calculated as a temperature difference value obtained by subtracting the inlet coolant temperature from the outlet coolant temperature, and the factors by the temperature difference ranges are applied as different factor granted values based on a size of the temperature difference value.

9. The method according to claim 8, wherein the temperature difference value is divided in the unit of 10° C.

10. The method according to claim 8, wherein the factor granted values are set to −1, 0, 1, 2, and 3 with respect to the temperature difference values of 0° C., 10° C., 20° C., 30° C., and 40° C., respectively.

11. The method according to claim 8, wherein the lack of the coolant amount is checked at the factor cumulative value that is larger than a factor threshold value.

12. The method according to claim 1, wherein an engine protection control is performed by:

switching the ITM valve to a full open state so that the coolant is distributed to a heat exchanger including at least one of a heater core and an ATF warmer as the coolant is distributed to a radiator; and operating a mechanical device associated with the engine to cool the coolant.

13. The method according to claim 12, wherein the mechanical device comprises at least one of a fuel injection device configured to control a fuel injection in a limp home control mode of the engine, and a cooling fan configured to blow and send an outdoor air to the radiator.

14. The method according to claim 12, wherein a warning light is turned on in a cluster of a driver's seat during an opening degree control of the ITM valve or an operation control of the mechanical device.

15. The method according to claim 1, wherein the controller is configured to reset and initialize the factor or store the factor in a memory when an operation of the engine is stopped.

16. An engine system comprising:

a first coolant temperature sensor configured to detect a coolant inlet temperature at an inlet of an engine;

a second coolant temperature sensor configured to detect a coolant outlet temperature at an outlet of the engine;

an integrated thermal management (ITM) valve configured to distribute a coolant to a heat exchanger associated with a radiator;

a controller configured to:

check that the coolant is distributed to the heat exchanger together with the radiator being switched from a closed state at a start of diagnosis to an open state during the diagnosis under the control of an opening degree of the ITM valve, calculate factors by temperature difference ranges as a factor cumulative value by an inlet/outlet coolant temperature difference calculated as a difference between the inlet coolant temperature and the outlet coolant temperature, and control the ITM valve to a full open state in case that a lack of a coolant amount is diagnosed; and an emergency control system being operated under the control of the controller and configured to delay an increase of the coolant temperature.

17. The engine system according to claim 16, wherein the heat exchanger comprises a heater core configured to raise an outdoor temperature through a heat exchange with the coolant and an auto transmission fluid (ATF) warmer performing heat exchange between an auto transmission fluid and the coolant.

18. The engine system according to claim 16, wherein the controller is provided with an emergency map, and in the emergency map, the inlet/outlet coolant temperature difference is divided in the unit of 10° C. to calculate factors by temperature difference ranges, and the factors by the temperature difference ranges are applied as different factor granted values based on the temperature differences.

19. The engine system according to claim 18, wherein the factor granted values are calculated as a factor cumulative value, and the diagnosis of the lack of the coolant amount is checked in case that the factor cumulative value is larger than a factor threshold value.

20. The engine system according to claim 16, wherein the emergency control system comprises a fuel injection device configured to convert a fuel injection into a condition of a limp home control mode, a cooling fan configured to blow an outdoor air to the radiator, and a warning light being turned on in a cluster of a driver's seat.

* * * * *